United States Patent [19]

Mei

[11] Patent Number: 4,675,059

[45] Date of Patent: Jun. 23, 1987

[54] NON-TOXIC, NON-CORROSIVE PRIMING MIX

[75] Inventor: George C. Mei, Creve Coeur, Mo.

[73] Assignee: Olin Corporation, Stamford, Conn.

[21] Appl. No.: 834,188

[22] Filed: Feb. 27, 1986

[51] Int. Cl.[4] ..... C06B 33/04

[52] U.S. Cl. ..... 149/43; 149/2; 149/21; 102/285; 102/289

[58] Field of Search ..... 149/2, 21, 43; 102/283, 102/285, 289

[56] References Cited

U.S. PATENT DOCUMENTS

| | | | |
|---|---|---|---|
| 3,926,119 | 12/1975 | Hurst et al. | 102/315 X |
| 4,047,989 | 9/1977 | Ostern | 149/88 X |
| 4,218,272 | 8/1980 | Brockington | 149/43 X |
| 4,376,002 | 3/1983 | Utracki | 149/40 X |
| 4,490,195 | 12/1984 | Cooper et al. | 149/45 X |
| 4,566,921 | 1/1986 | Duguet | 149/22 |

*Primary Examiner*—Peter A. Nelson

*Attorney, Agent, or Firm*—Bruce E. Burdick

[57] ABSTRACT

This invention relates to priming compositions for ammunitions containing manganese dioxide as oxidizer agent in the primer mix, and to the rimfire cartridge containing dinol, manganese dioxide, tetrazene and glass.

7 Claims, No Drawings

NON-TOXIC, NON-CORROSIVE PRIMING MIX

This invention was developed under government contract, but the assignee has elected to retain title to the patent. The invention may be used by or for the U.S. Government without payment of royalty.

This invention relates to priming compositions for ammunition.

BACKGROUND AND SUMMARY OF THE INVENTION

There is international concern about the amount of airborne toxic materials found in shooting ranges, particularly airborne lead. The Federal Government of West Germany has set the maximum permissible workplace concentration of lead dust at 0.1 mg of lead per cubic meter of air. During tests at German and non-German shooting ranges, equipped with various types of ventilation systems, concentrations of up to 9 mg of lead per cubic meter were measured over exposures of 4–6 hours when conventional, fully jacketed 9×19 mm Luger (parabellum) ammunition was used. This high airborne lead concentration is also found in some indoor shooting ranges using .22 caliber rimfire ammunition. The main problem is thought to come from the lead styphnate and barium nitrate used in the priming composition.

One attempt to solve the above problem for centerfire ammunition (which has a primer placed in the center of the cartridge base) has been the "Sintox" primer developed by Dynamit Nobel of Troisdorf, West Germany which is thought to use an amorphous dinol initiating explosive mixed with zinc and titanium compounds rather than lead or barium compounds. However, that priming composition is not suitable for priming rimfire cartridges because it is a centerfire priming mix which does not have enough sensitivity for use as a rimfire priming mix and because it does not easily flow into the rim of the cartridge during the priming procedure. Dinol-based priming mix having a smaller crystalline size than that of the "Sintox" primer was made and was tried by applicant's predecessors at Olin Corporation about 40 years ago, but that mix contained lead in forms of lead thiocyanate and lead peroxide and is thus not suitable as a lead-free primer mix.

A solution to this problem of needing a lead-free, non-toxic .22 caliber rimfire primer has been long sought after. Rimfires have been in existence for many, many years without such a primer having been found. It is well known that rimfire priming mixes must have a sensitivity which is considerably lower than that required by centerfire primers, so even if a low sensitivity lead-free centerfire primer mix is found, it is not obvious how to make a high sensitivity lead-free, non-corrosive, non-toxic rimfire priming mix. The problem is such that the U.S. Government's Army Research and Development Center issued a contract to Olin Corporation to study the feasibility of developing such a primer.

A solution to the above problem is achieved by the present invention which provides a priming composition for use in rimfire cartridges, which composition consists essentially of dinol, manganese dioxide, tetrazene and glass. It is believed that manganese dioxide has never before been used as an oxidizer in ammunition primers, and especially not in rimfire cartridges.

DETAILED DESCRIPTION

The priming mix of the invention contains dinol as the initiating explosive, manganese dioxide as the oxidizer, tetrazene as the sensitizer and glass as the co-sensitizer and is intended for use in rimfire cartridges such as .22 caliber cartridges. The manganese dioxide-dinol combination is essential to the overall success of the dinol based primer mix because to $MnO_2$ provides the needed oxidizer strength to catalize the reaction and has water insolubility for wet processing without being corrosive (as are halogen-containing oxidizers or explosives).

The manganese dioxide concentration in the mix can range from about 10% up to about 40% by weight, with the particular concentration dependent on the relative concentrations of the other ingredients in the mix. A manganese dioxide concentration in the mix within the range of from about 15% to 25% by weight of the mix is preferred.

The dinol particles should be small enough to pass through a screen having 250 micron openings. One such dinol particle is that made according to the procedure described in U.S. Pat. No. 2,408,059, issued to Olin Industries, Inc. (now Olin Corporation) entitled "Manufacture of Diazodinitrophenol" and issued Sept. 24, 1946, the disclosure of which is incorporated herein by reference as if set forth at length. The U.S. Pat. No. 2,408,059 calls for use of an adsorbed triphenylmethane dye as a crystal growth control agent.

The concentration of dinol in the present priming mix of the invention is within the range of from about 25% up to about 40% by weight. The precise concentration of dinol is dependent on the amount of tetrazene, since those two ingredients provide the explosive energy to the mix. It is preferred that the combined weight percentages of dinol and tetrazene in the mix be within the range of from about 40% to about 60%.

The tetrazene can be standard commercial grade and is used in the mix in a concentration by weight within the range of from about 10% to about 40% of the mix.

The glass can be standard rimfire glass (i.e. the same glass as used in conventional rimfire primers) and is used in the mix in a concentration by weight within the range of from about 10% to about 30% of the mix.

The mixture can be made by a wet process, which is very desirable for rimfire applications where the primer is typically spun into the rim and the liquid flow properties are needed for uniformity of primer around the rim.

One advantage of the mix of the invention is that it contains no heavy metals such as lead or barium and thus is not toxic. The mix also contains to halogens and is non-corrosive. This is believed to be the first and only non-corrosive, non-toxic rimfire mix which can be safely and economically substituted for existing lead and barium containing rimfire primers without causing primer-related ammunition defects such as misfires, no-fires, hang fires or premature fires.

EXAMPLES

1. A priming composition was prepared by mixing water-desensitized tetrazene to form the premix. To this premix was then added glass and manganese dioxide in layers. Subsequent thorough mixing completed the process. This mix (MIX16E) had a composition of 30% by weight dinol, 30% by weight tetrazene, 20% manganese dioxide and 20% standard rimfire fine glass. This water wetted mix was applied into the rims of .22LR cartridges in an amount calculated to give a dry primer mix charge weight of 0.6 grains.

Sensitivity of the primed case with the mixture was tested by using Probst's method which a 1.94 ounce steel ball from measured heights varied by one inch increments. Twenty-five primed cases were tested at 11" drop height and all fired without misfire. Using the Probst method, the average drop height for 50% fire ("H") was 5.7" with a standard deviation ("S") of 0.4" with H+4S=7.3" and H-2S=4.7". For standard testing of safety, 100 shellcases primed with the composition are tested by dropping a 1.94 ounce steel ball from a height of one inch onto the rim of the case. No detonations occur, thus indicating the cartridges are not overly sensitive and should be safe to handle (a single detonation is considered a failure in this safety test).

Ignition characteristics were tested by measuring pressure and velocity (P&V), ignition barrel time (IBT) and pressure-time characteristics (P-T). The results were:

V=1488 fps

P=23,000 psi

IBT=1.92 ms when loaded into a standard .22 caliber case with a 29 grain standard LR projectile and 1.8 grain of Bullseye #85 propellant.

Stability of the primer was tested by storing 20 rounds of .22LR cartridges having the priming mix composition and 20 rounds of standard .22LR cartridges at 115° F. at 85% relative humidity and also at 70° F. for 2 weeks. The cartridges were then fired to determine pressure and velocity. Pressure and velocity were not found to change significantly, thus the primer was judged stable.

The primer was tested for function and casualty by shooting 100 rounds of .22LR cartridges primed with the priming composition and 100 rounds of standard .22LR cartridges in each of 5 types of .22 caliber rifles used by the U.S. Government. Function and casualty were found to be equivalent to conventional primed cartridges. Function and casualty done five months after loading were also found to be equivalent to conventional rounds with no change in the results.

The net result of all of the testing was that the non-toxic, lead-free priming composition of the invention was found to be effective.

What is claimed is:

1. A priming composition for use in rimfire cartridges which consists essentially of a lead-free, non-toxic, non-corrosive mixture of dinol, manganese dioxide, tetrazene and glass.

2. The composition of claim 1 in which the weight percentage of the ingredients in the composition is within the following ranges:

dinol: 25%–40% manganese dioxide: 10%–40% tetrazene: 10%–40% glass: 10%–30%

3. The composition of claim 2 wherein the dinol has a particle size within the range of from about 30 microns up to about 250 microns.

4. The composition of claim 2 wherein the combined weight percentage of dinol and tetrazene in the composition is within the range of from about 40% up to about 60%.

5. The composition of claim 2 wherein the weight percentage of manganese dioxide in the mix is within the range of from about 15% to about 25%.

6. The composition of claim 2 wherein the weight percentage of dinol in the mix is within the range of from about 25% to about 35%.

7. A non-corrosive ammunition priming mix which contains manganese dioxide as an oxidizer agent.

* * * * *